US007959061B2

(12) United States Patent
Kaltman et al.

(10) Patent No.: US 7,959,061 B2
(45) Date of Patent: Jun. 14, 2011

(54) FOLDED POT COVER

(75) Inventors: Dennis M. Kaltman, Princeton, NJ (US); Richard C. Thibault, Westchester, PA (US); John R. Widener, Haslett, MI (US); Carol J. Moore, Grand Rapids, MI (US)

(73) Assignee: Multi Packaging Solutions, Inc., Lansing, MI (US)

( * ) Notice: Subject to any disclaimer, the term of this patent is extended or adjusted under 35 U.S.C. 154(b) by 0 days.

(21) Appl. No.: 12/566,766

(22) Filed: Sep. 25, 2009

(65) Prior Publication Data

US 2011/0072719 A1 Mar. 31, 2011

(51) Int. Cl.
*B65D 5/22* (2006.01)
*B65D 5/42* (2006.01)
*A01G 9/02* (2006.01)

(52) U.S. Cl. ..... 229/114; 47/72; 47/74; 206/459.5; 206/485; 206/485.1; 206/565; 206/784; 229/175; 229/186; 229/931

(58) Field of Classification Search ..... 229/114, 229/175, 176, 186, 931; 206/427, 476, 485, 206/485.1, 562–565, 784; 47/72, 74; 40/312
See application file for complete search history.

(56) References Cited

U.S. PATENT DOCUMENTS 329,559 A 11/1885 Hohenstein
1,046,017 A 12/1912 Reber
1,778,462 A 10/1930 Nourse et al.
1,833,492 A * 11/1931 Miller ..... 229/186
2,151,472 A 3/1939 Hubbard
2,189,602 A 2/1940 Denny
2,306,624 A * 12/1942 Harris ..... 206/485
2,334,425 A * 11/1943 Lowey ..... 229/175
2,391,767 A 12/1945 Beerend
2,536,530 A 1/1951 Bergstein
2,621,783 A * 12/1952 Buttery ..... 206/562
2,702,663 A * 2/1955 Klein ..... 229/176
2,942,769 A * 6/1960 Kuchenbecker ..... 229/176
2,944,719 A 7/1960 Arneson
3,091,381 A * 5/1963 Conescu ..... 229/186
3,314,194 A 4/1967 Halleck (Continued)

FOREIGN PATENT DOCUMENTS

DE 7819435 U1 10/1978

(Continued)

OTHER PUBLICATIONS

Co-pending Design U.S. Appl. No. 29/350,841, filed Nov. 24, 2009.

(Continued)

*Primary Examiner* — Gary E Elkins
(74) *Attorney, Agent, or Firm* — Dobrusin & Thennisch PC

(57) ABSTRACT

A foldable pot cover provides a foldable die cut pattern which can be imprinted on its exterior surfaces with any of a number of designs. The pot cover is formed from a die cut pattern which can be folded into overlapping flaps and tabs which are folded and interlocked to define a generally trapezoidal pot cover which can receive a variety of different pot sizes and types and resists moisture. The die cut pattern forming the pot cover can be of a universal shape but formed in a variety of different sizes to accommodate different sized potted plants.

15 Claims, 5 Drawing Sheets

U.S. PATENT DOCUMENTS

| | | | | | |
|---|---|---|---|---|---|
| 3,338,503 | A | | 8/1967 | Beh | |
| 3,443,681 | A | * | 5/1969 | Wysocki | 206/485.1 |
| 3,465,948 | A | * | 9/1969 | Boyer | 229/103.11 |
| 3,559,869 | A | | 2/1971 | Reynolds | |
| 3,567,106 | A | | 3/1971 | Anderson | |
| 3,606,078 | A | | 9/1971 | Phillips, Jr. | |
| 3,754,642 | A | | 8/1973 | Stidolph | |
| 3,869,828 | A | | 3/1975 | Matsumoto | |
| 3,913,823 | A | | 10/1975 | Lin | |
| 3,993,240 | A | * | 11/1976 | Matsuyama | 229/125.19 |
| 4,055,293 | A | * | 10/1977 | Stramaglia | 229/176 |
| 4,119,265 | A | | 10/1978 | Dlugopolski | |
| 4,242,835 | A | | 1/1981 | Mondragon Sorribes | |
| 4,260,098 | A | | 4/1981 | Manizza et al. | |
| 4,512,511 | A | * | 4/1985 | Zimmermann | 206/774 |
| D317,582 | S | | 6/1991 | Weder | |
| 5,029,708 | A | | 7/1991 | Alonso et al. | |
| 5,070,645 | A | | 12/1991 | Vaughn | |
| D326,246 | S | | 5/1992 | Weder | |
| D326,830 | S | | 6/1992 | Vaughn | |
| D327,234 | S | | 6/1992 | Vaughn | |
| D327,236 | S | | 6/1992 | Weder | |
| 5,174,061 | A | | 12/1992 | Dambricourt | |
| 5,221,248 | A | | 6/1993 | Weder et al. | |
| 5,254,072 | A | | 10/1993 | Weder et al. | |
| 5,284,294 | A | | 2/1994 | Floyd | |
| D360,387 | S | | 7/1995 | Weder et al. | |
| D361,738 | S | | 8/1995 | Shryock | |
| D363,450 | S | | 10/1995 | Weder et al. | |
| D398,261 | S | | 9/1998 | Weder et al. | |
| 5,853,121 | A | | 12/1998 | Francisco | |
| 6,050,483 | A | | 4/2000 | Haraldsson et al. | |
| 6,345,467 | B1 | | 2/2002 | Weder | |
| 6,421,959 | B1 | | 7/2002 | Van Laere | |
| 6,561,353 | B2 | | 5/2003 | Levieux et al. | |
| D480,660 | S | | 10/2003 | Faulkner | |
| 6,745,514 | B1 | | 6/2004 | Myrland | |
| 6,782,659 | B2 | | 8/2004 | Van Laere | |
| D572,169 | S | | 7/2008 | DeRoeck | |
| D630,548 | S | | 1/2011 | Kaltman et al. | |
| 7,870,995 | B1 | * | 1/2011 | Kaltman et al. | 229/175 |
| 2002/0038527 | A1 | | 4/2002 | Weder | |
| 2002/0148159 | A1 | | 10/2002 | Weder | |
| 2002/0184821 | A1 | | 12/2002 | Campeau | |
| 2003/0197053 | A1 | | 10/2003 | Haraldsson | |
| 2004/0031842 | A1 | | 2/2004 | Westerman et al. | |
| 2008/0060270 | A1 | | 3/2008 | Weder | |

FOREIGN PATENT DOCUMENTS

| | | | | |
|---|---|---|---|---|
| DE | 9011923 | U1 | | 10/1990 |
| EP | 1084958 | A1 | | 3/2001 |
| GB | 477926 | A | | 1/1938 |
| GB | 490316 | A | | 8/1938 |
| GB | 714265 | A | | 8/1954 |
| GB | 2121383 | | | 12/1983 |
| GB | 2121383 | A | | 12/1983 |
| GB | 2276870 | A | | 10/1994 |
| GB | 2276870 | | | 12/1994 |
| GB | 2415956 | A | * | 1/2006 |
| GB | 2415956 | A | | 1/2006 |
| WO | 02/076840 | A1 | | 10/2002 |

OTHER PUBLICATIONS

Co-pending PCT Utility Patent Application No. US09/64420; Filed Nov. 13, 2009.

Co-pending Utility U.S. Appl. No. 12/618,395, filed Nov. 13, 2009; Issued Jan. 18, 2011 as US Patent No. 7,870,995.

Co-pending Design U.S. Appl. No. 29/344,203, filed Sep. 25, 2009; Issued Jan. 11, 2011 as Design Patent No. D630,548.

Co-pending Utility U.S. Appl. No. 12/976,065, filed Dec. 22, 2010.

International Search Report dated Jul. 8, 2010, PCT/US2009/064420; Filed Nov. 13, 2009.

* cited by examiner

FOLDED POT COVER

BACKGROUND OF THE INVENTION

The present invention relates to a cover for receiving a potted plant.

Potted plants are frequently covered for use directly in the home with foil or polymeric film preshaped into a size into which a pot will fit. Although such covers for conventional plastic pots or clay pots allow the homeowner to display the potted plant without the expense of replanting the plant in an expensive decorative flower pot, such foil and plastic covers are not particularly attractive. Also, such covers are typically preformed to an existing inexpensive flower pot and cannot be removed or used for a variety of different sized flower pots.

Accordingly, there exists a need for a pot cover which is durable, can be employed for a variety of pot sizes and shapes, and yet provide a quality decorative container for displaying live plants in a home or business environment.

SUMMARY OF THE INVENTION

The pot cover of the present invention satisfies these needs by providing a foldable die cut pattern which can be imprinted on its exterior surfaces with any of a number of designs to provide the purchaser with a selection of decorative pot covers to conform to the décor of the location in which a plant will be displayed. It achieves this goal by utilizing a relatively inexpensive paperboard which is laminated on at least one side with a polymeric film and printed on its exterior with a decorative design. In a preferred embodiment of the invention, the pot cover is formed from a die cut pattern which can be folded into overlapping flaps and tabs which are folded and interlocked to define a generally trapezoidal pot cover which can receive a variety of different pot sizes and types and resists moisture. The die cut pattern forming the pot cover can be of a universal shape but formed in a variety of different sizes to accommodate different sized potted plants.

In a preferred embodiment of the invention, the pot covers can be shipped prior to assembly to a retail establishment, such as a nursery, florist, or mass merchandise outlet and either assembled by the merchant or provided with assembly instructions for the purchaser. The pot covers can also be preassembled by the manufacturer and shipped in stacked relationship to the retail merchant. Regardless of the manner in which they are provided to the customer, the pot covers are durable, attractive and provide the consumer with a wide selection of sizes and decorative patterns. The cover defines a container which also can be used to hold fresh flower arrangements, gifts, gourmet foods, candy, or other gift items.

These and other features, objects and advantages of the present invention will become apparent upon reading the following description thereof together with reference to the accompanying drawings.

DETAILED DESCRIPTION OF THE PREFERRED EMBODIMENT

Figure 1:
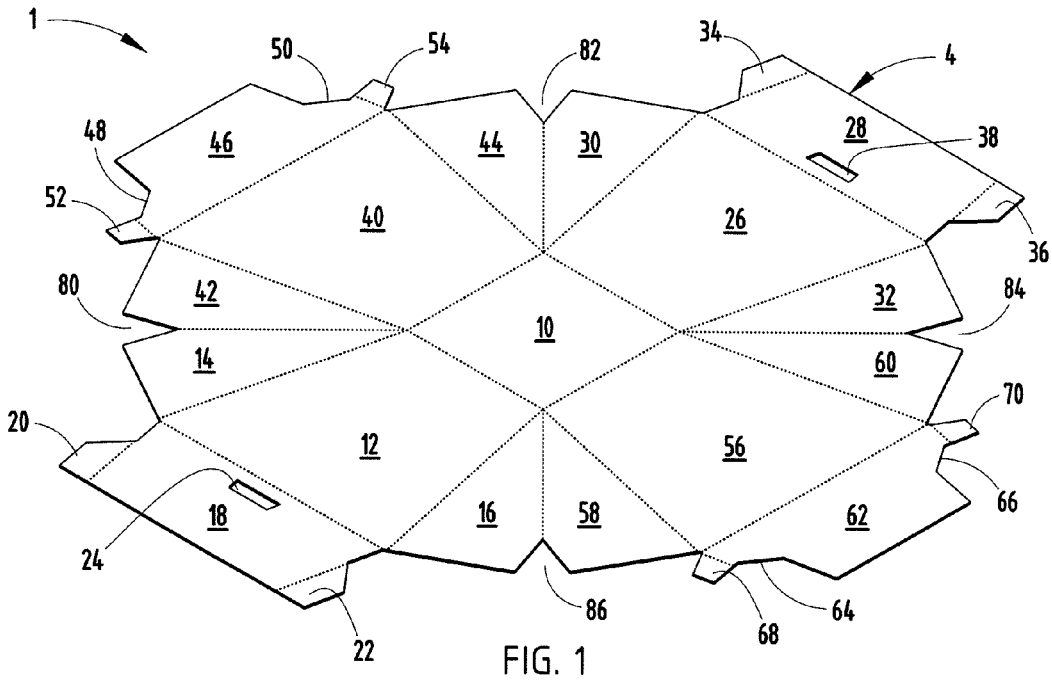
FIG. 1 is a perspective view of a die cut pattern for forming a pot cover of the present invention.
Figure 2:
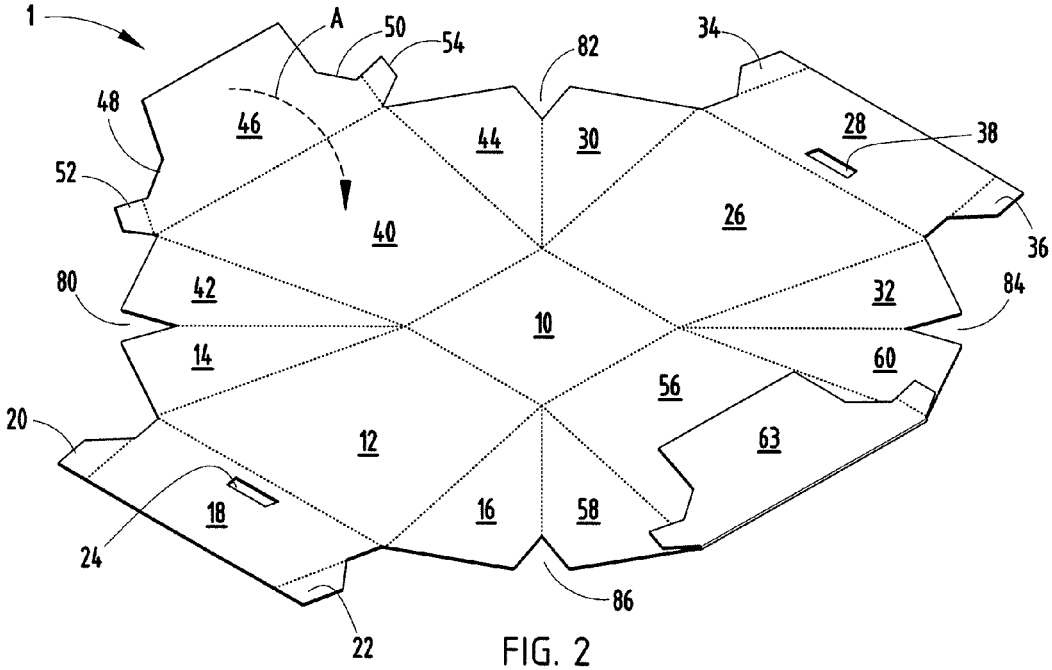
FIG. 2 is an illustration of the pot cover shown during a first step of assembly.
Figure 9:
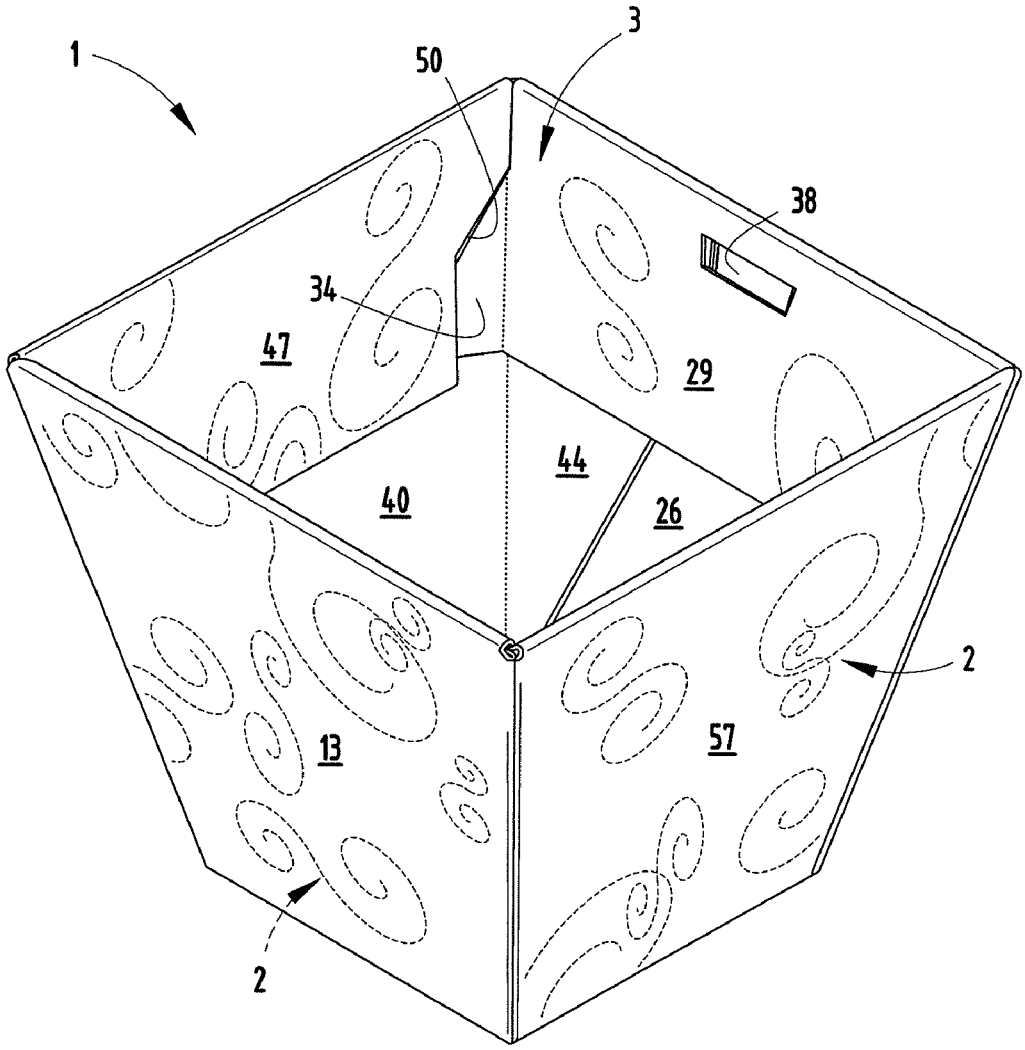
FIG. 9 is a perspective view of a completed pot cover embodying the present invention.

Referring initially to FIGS. 1 and 9, there is shown a pot cover 1 embodying the present invention, which is formed from a die cut pattern 4 made of a suitable paperboard material. In one embodiment, the material is a C1S (coated one side) SBS (solid bleached sulfate) about 14 point to about 22 point paperboard laminated with a polyethylene film of from about 0.005 to about 0.0075 inches thick. The material forming the die cut pot cover 1 can be poly-coated on both sides and, as seen in FIG. 1, the interior side of the pot cover is shown, which is always poly-coated. The opposite surface of the die cut pattern forming the outer surface of the pot cover is printed with decorative indicia 2, which can be any type of design. The printing can have a holiday theme, such as Christmas decorations, photographic scenes, a Valentine's Day theme, and any decorative pattern or style desired. Thus, the use of a die cut pattern for forming the pot cover 1 allows one side of the material to be printed with practically any desired indicia 2 including foil, textured foil and the like. The resultant, generally trapezoidal pot cover 1, as seen in FIG. 9, has a relatively large rectangular top opening 3 which allows the easy insertion of a pot therein. By providing the generally trapezoidal sides of the pot cover 1, a unique design appearance is provided by the pot cover which further enhances its aesthetic appearance.

Referring now to FIG. 1, there is shown a die cut pattern or form 4 for a pot cover 1 embodying the present invention. The pattern integrally includes a generally square base 10, having a first side panel 12 integrally extending therefrom with two generally triangular side flaps 14 and 16. An end flap 18 integrally extends from side 12 and includes outwardly extending tabs 20 and 22. On the opposite side of base 10 is a second integral side 26 extending from base 10 and integrally including triangular flaps 30 and 32 and an outwardly extending top flap 28. Flap 28 also includes outwardly extending tabs 34 and 36 for locking the pot cover in an assembled position as described below. Each of the flaps 18 and 28 also include a slot 24 and 38, respectively, for providing a gripping handhold.

Additional side panels 40 and 56 integrally extend from base 10 in a direction orthogonal to side panels 12 and 26. Panel 40 integrally includes triangular flaps 42 and 44 on opposite sides, which adjoin and are integrally coupled to flaps 14 and 30. Side 40 includes an outwardly extending end flap 46, which includes laterally extending tabs 52 and 54 coupled to the generally rectangular flap 46 by angled corners 48 and 50. On the opposite side of base 10 is a similar side panel 56 integrally bordered by triangular flaps 58 and 60, which integrally adjoin flaps 16 and 32, respectively. Extending outwardly from side 56 is a generally rectangular flap 62 having outwardly extending tabs 68 and 70 with angled corners 64 and 66, respectively. The integral triangular flaps 14, 42; 16, 58; 30, 44; and 32, 60 form a foldable web between the sides 12, 26 and 40, 56, as seen in the assembly steps illustrated in FIGS. 3-8.

The phantom lines shown in FIGS. 1-8 represent fold lines for the assembly process, which can either be manual or can be machine assembled if desired. The assembly (i.e., folding) process is shown in FIGS. 2-8 in which first the end flaps 46 and 62 are folded over onto sides 40 and 56, respectively, in the direction of arrow A in FIG. 2. The inner surfaces of flaps 46 and 62 may, if desired, be adhesively attached to the inside of sides 40 and 56. Such step may, however, be unnecessary with the interlocking flaps and tabs holding the pot cover in an assembled state. The outer surfaces of the panels and flaps shown in FIG. 1 are identified in the remaining drawing figures with the same number incremented by a single digit. Thus, for example, in FIG. 2, the outer surface of flap 62 is identified as 63.

Figure 3:
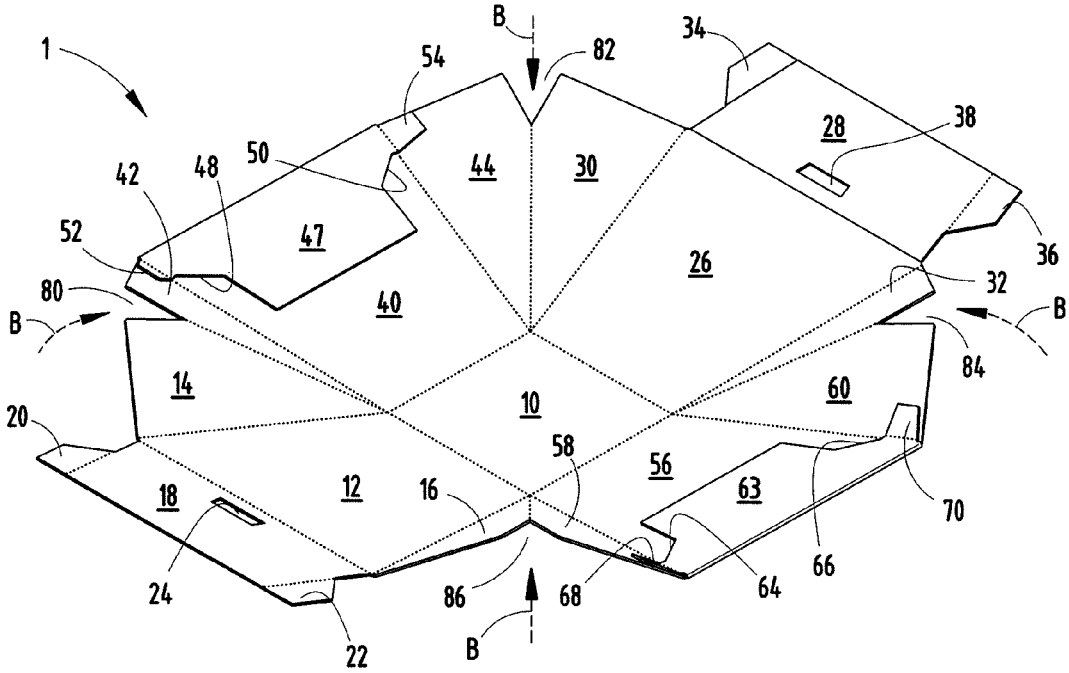
FIG. 3 is a perspective view of the pot cover shown in a second step of assembly.

Next, as illustrated in FIG. 3, the adjacent triangular panels 14, 42, 16, 58, 32, 60, 30, and 44 are deflected inwardly as shown by arrow B in FIG. 3.

Figure 4:
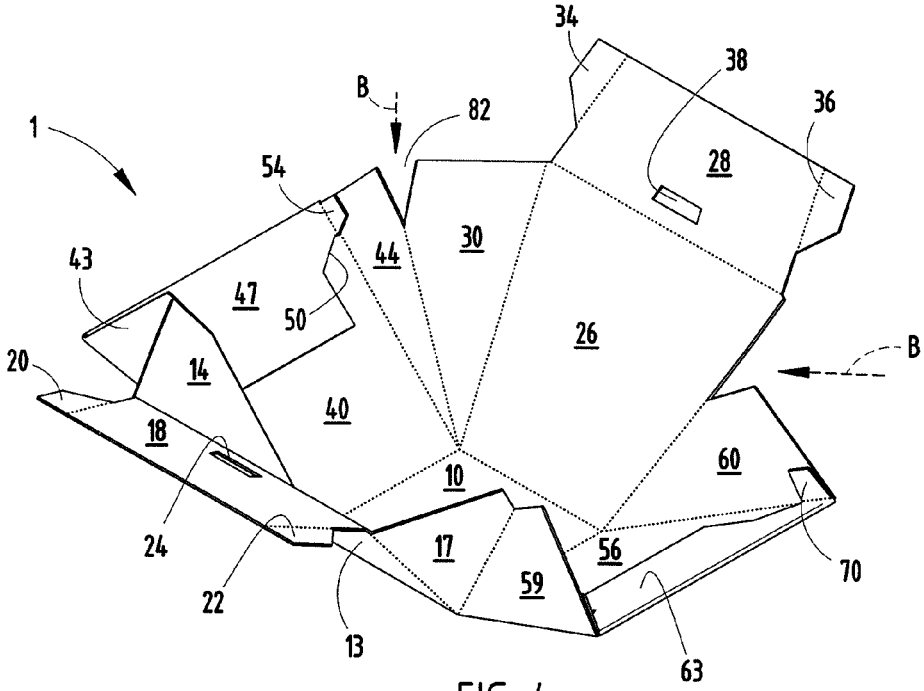
FIG. 4 is a perspective view of a pot cover shown in a third step of assembly.
Figure 5:
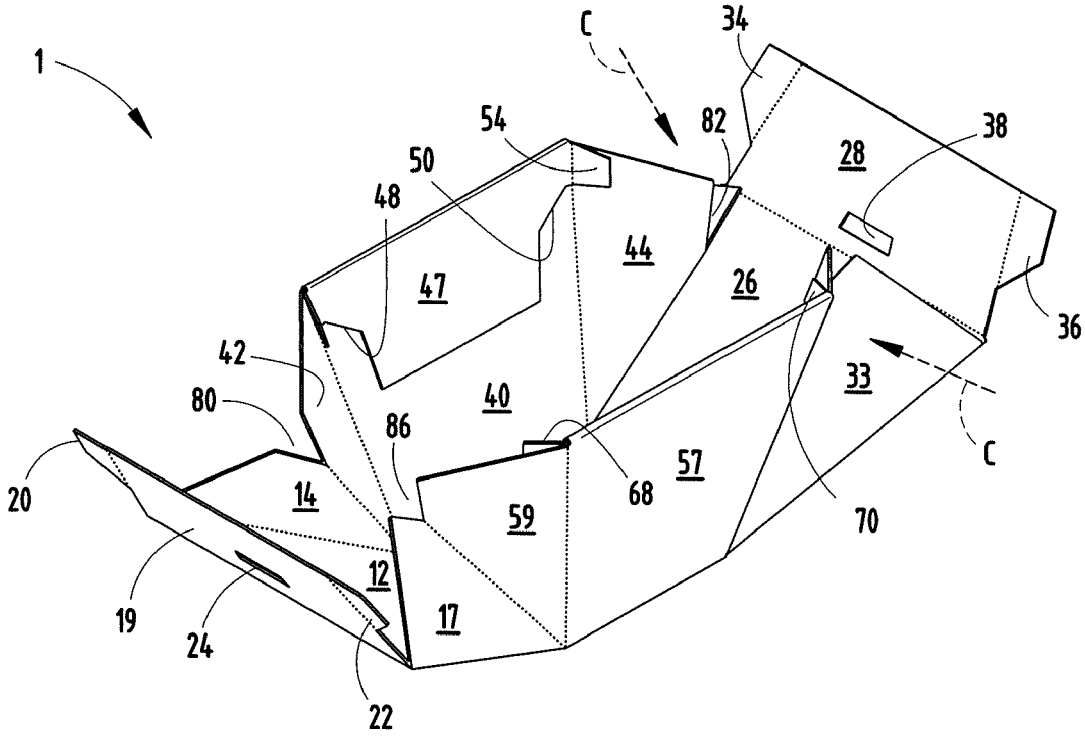
FIG. 5 is a perspective view of a pot cover shown in a fourth step of assembly.

This process is continued, as illustrated by arrow B in FIG. 4, until the sides 40 and 56 are substantially vertical, as shown in FIG. 5. The outer surface 57 of panel 56 is imprinted with an indicia 2, as shown in FIG. 9, as are the remaining external surfaces of the pot cover 1. With the sides 40 and 56 substantially in the position shown in FIG. 5, the sides 12 and 26 are then folded inwardly, as indicated by arrow D in FIG. 6, such that with the tabs 68, 70, 52, and 54 project inwardly from sides 40 and 56 and lie adjacent triangular flaps 58, 60; and 42, 44, respectively.

Figure 6:
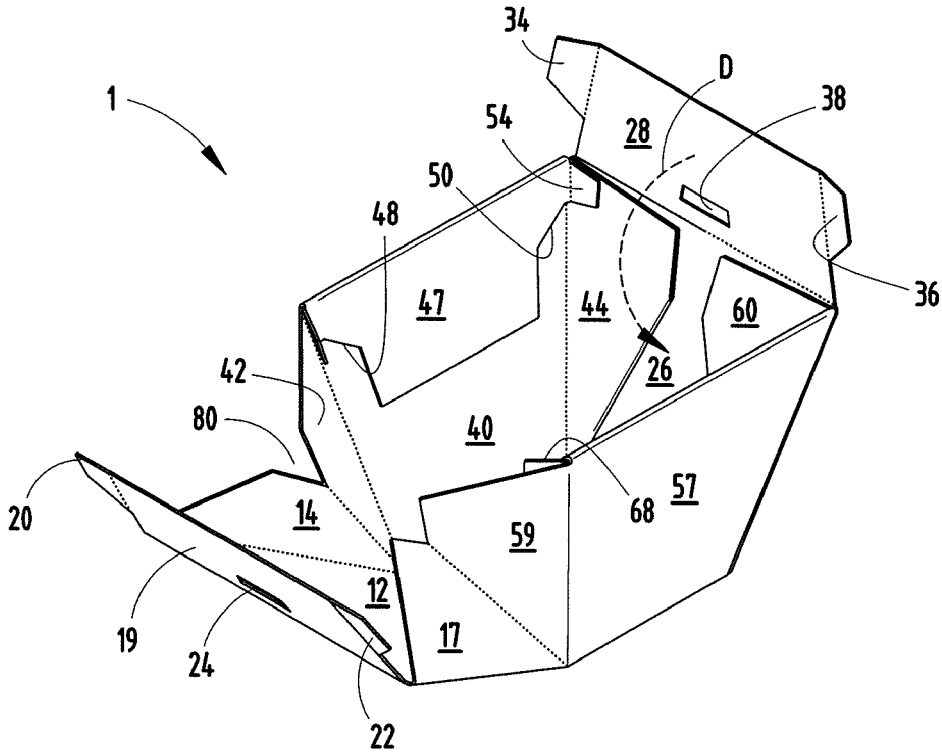
FIG. 6 is a perspective view of a pot cover shown in a fifth step of assembly.
Figure 7:
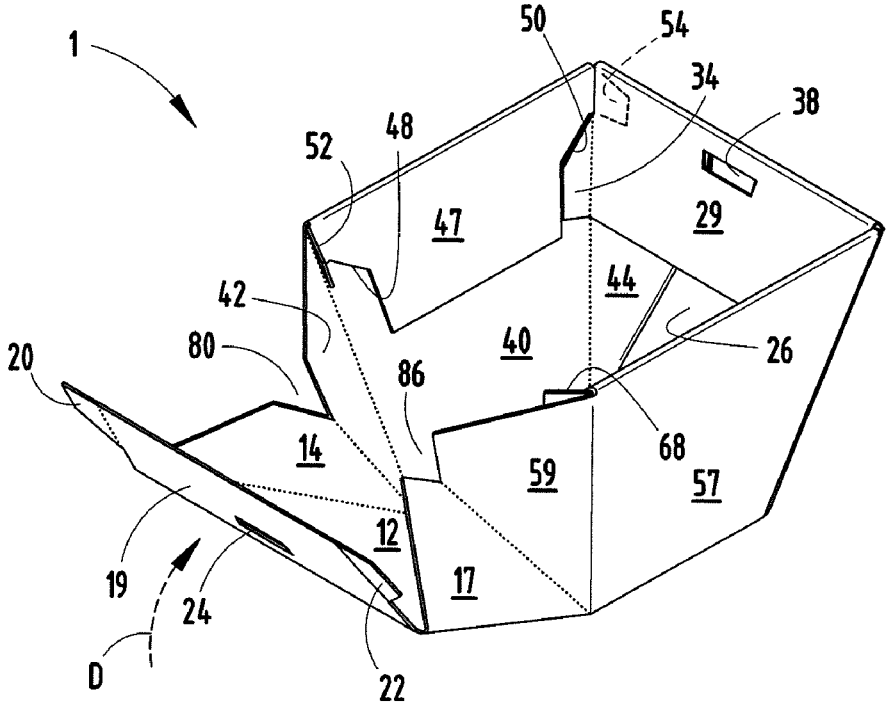
FIG. 7 is a perspective view of a pot cover shown in a sixth step of assembly.
Figure 8:
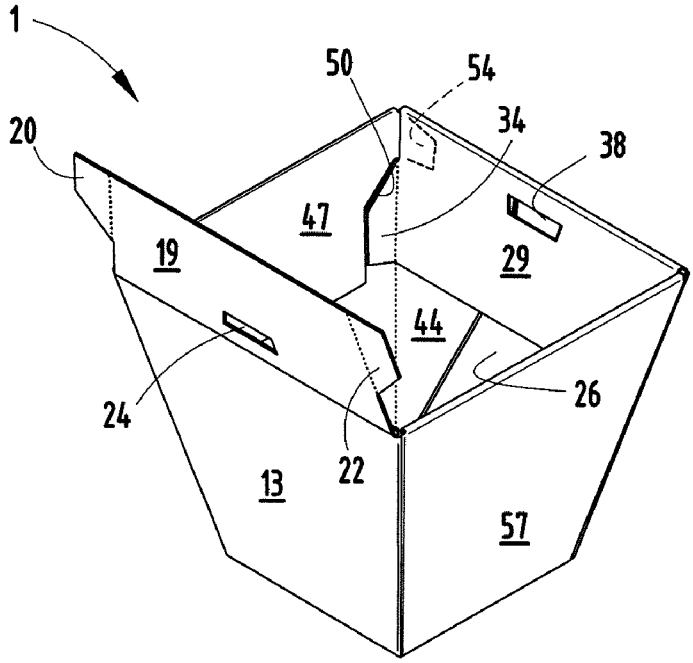
FIG. 8 is a perspective view of a pot cover shown in a seventh step of assembly.

Next, the end flaps 18 and 28 are folded over, as shown by arrow D in FIG. 6, and tabs 34 and 36 and 20 and 22 are tucked over tabs 52, 54, 68, and 70, respectively, and under flaps 46 and 62, as seen in FIGS. 7 and 8, to interlock the edges of the pot cover to a completely assembled position as shown in FIG. 9. The outer surface 13 of panel 12 likewise is imprinted with indicia 2 as are the remaining outer surfaces, including the outer surfaces 47 of flap 46, 63 of flap 62, surface 19 of flap 18 and surface 29 of flap 28. Thus, the exposed surfaces of pot cover 1 which are visible, including the outer surfaces of the cover itself, and the inner surfaces of the flaps which are exposed when looking downwardly from the top edge of the cover are decoratively imprinted. The indicia 2 can be printed in any commercially known manner. The slots 24 and 38 in flaps 18 and 28, respectively, provide handholds for lifting the cover and plant if a potted plant is to be moved.

Thus, by providing interlocking tabs 52, 54, 68, and 70 with tabs 20, 22 and 34, 36 folded over and under flaps 46 and 62, respectively, the top edges of the pot cover interlock. By providing the V-shaped notches 80, 82, 84, and 86 between adjacent triangular panels 14, 42; 44, 30; 32, 60; and 16, 58, respectively, clearance is provided for the interlocking tabs and flaps to allow the ready assembly of the pot cover. Handholds 24 and 38 are interior of the pot cover and, therefore, are relatively unobtrusive and do not detract from the ornamental appearance of the resultant pot cover when assembled as seen in FIG. 9.

The pot cover 1 is preferably made to accommodate standard sized pots, such as 4", 6", and 8" pots, although any desirable size can be employed. For a 6" pot, for example, the square bottom 10 was approximately 4½" on each side while the sides had a height of approximately 5¼" and a width at the top of 6". The overlapping and interlocking flaps 18, 28, 46 and 62 extended downwardly into the pot cover approximately 2½". For different sized pots, these dimensions will be varied proportionally. Although the poly-coated paperboard, which is film covered on one or both sides and printed with a decorative design on the exterior surface, is preferred, other foldable, interlocking materials could be employed.

It will become apparent to those skilled in the art that various modifications to the preferred embodiment of the invention as described herein can be made without departing from the spirit or scope of the invention as defined by the appended claims.

The invention claimed is:

1. A die cut pattern for a forming a folded pot cover comprising:

an interior surface including a polymeric coating and no printed indicia;

an exterior surface including printed indicia and no polymeric coating, a base;

four outwardly extending trapezoidal sides integral with said base and including adjacent flaps forming a webs between the adjacent sides, said sides further including end flaps; and tabs extending laterally from said end flaps such that they interlock with the adjacent end flaps when folded to form a pot cover;

wherein upon folding, the end flaps that contain printed indicia extend downward to cover a portion of the interior of the sides so that an interior line spaced upwardly from the base of the folded pot cover is created where the printed indicia stops and the polymeric coating begins.

2. The pattern as defined in claim 1 wherein said adjacent web forming flaps are generally triangular.

3. The pattern as defined in claim 2 wherein said web forming flaps include an inwardly extending notch to provide clearance for folding said web.

4. The pattern as defined in claim 3 wherein tabs on the adjacent end flaps have different dimensions.

5. The pattern as defined in claim 1 wherein said pattern is made from about 14 point to about 22 point SBS paperboard.

6. The pattern as defined in claim 5 wherein the interior includes a polymeric material having a thickness of from about 0.005 inches to about 0.0075 inches.

7. A folded pot cover comprising:

an interior surface including a polymeric coating and no printed indicia;

an exterior surface including printed indicia and no polymeric coating;

four trapezoidal sides joined by integral folded web sections; a base integral with said sides; and end flaps integral with said sides and extending within the interior of said pot cover, said end flaps including locking tabs which interlock with the adjacent end flaps;

wherein upon folding, the end flaps that contain printed indicia extend downward to cover a portion of the interior of the sides so that an interior line spaced upwardly from the base of the folded pot cover is created where the printed indicia stops and the polymeric coating begins.

8. The pot cover as defined in claim 7 wherein said web sections are triangular flaps.

9. The pot cover as defined in claim 8 wherein said cover is made from about 14 point to about 22 point SBS paperboard.

10. The pot cover as defined in claim 7 wherein the interior includes a polymeric material having a thickness of from about 0.005 inches to about 0.0075 inches.

11. The pot cover as defined in claim 9 wherein said printed indicia is a holiday theme.

12. A method of forming a pot cover comprising the steps of:

providing a pattern integrally including a square base and integral side panels with end flaps and outwardly extending tabs;

printing indicia onto the exterior of the pot cover;

coating the interior of the pot cover with a polymeric coating while leaving the exterior of the pot cover free of a polymeric coating;

folding the flaps of a pair of the opposed side panels downward to cover a portion of the interior of the sides so that an interior line spaced upwardly from the base of the folded pot cover is created where the printed indicia stops and the polymeric coating begins;

folding the side panels upwardly; and tucking said tabs from the adjacent end flaps over the adjacent tabs and under the adjacent end flaps to lock the side panels together.

13. The method as defined in claim 12 and further including the step of providing a folding web between the adjacent side panels.

14. The method as defined in claim 12 wherein said first named providing step comprises making said pattern from about 14 point to about 22 point SBS paperboard.

15. The method as defined in claim 12 wherein said coating step comprises covering said pattern with a film of polymeric material having a thickness of from about 0.005 inches to about 0.0075 inches.

* * * * *

UNITED STATES PATENT AND TRADEMARK OFFICE

CERTIFICATE OF CORRECTION

PATENT NO. : 7,959,061 B2
APPLICATION NO. : 12/566766
DATED : June 14, 2011
INVENTOR(S) : Dennis M. Kaltman et al.

It is certified that error appears in the above-identified patent and that said Letters Patent is hereby corrected as shown below:

Claim 10, line 57, "The pot cover as defined in claim 7" should instead read,
--The pot cover as defined in claim 9--.

Claim 12, line 67, "printing indicia onto the exterior of the pot cover;" should instead read,
--printing indicia onto the exterior of the pot cover including the exterior surface of the end flaps;--.

Signed and Sealed this
Ninth Day of August, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,959,061 B2
APPLICATION NO. : 12/566766
DATED : June 14, 2011
INVENTOR(S) : Dennis M. Kaltman et al.

It is certified that error appears in the above-identified patent and that said Letters Patent is hereby corrected as shown below:

Claim 10, Column 4, line 57, "The pot cover as defined in claim 7" should instead read,
--The pot cover as defined in claim 9--.

Claim 12, Column 4, line 67, "printing indicia onto the exterior of the pot cover;" should instead read,
--printing indicia onto the exterior of the pot cover including the exterior surface of the end flaps;--.

This certificate supersedes the Certificate of Correction issued August 9, 2011.

Signed and Sealed this
Thirtieth Day of August, 2011

David J. Kappos

David J. Kappos
*Director of the United States Patent and Trademark Office*